US006463658B1

(12) United States Patent
Larsson

(10) Patent No.: US 6,463,658 B1
(45) Date of Patent: Oct. 15, 2002

(54) METHOD FOR MANUFACTURING DIFFUSORS FOR SHOWER HEADS

(76) Inventor: Nils Larsson, Dalavägen 50, Västra Frölunda (SE), S-421 68

( * ) Notice: Subject to any disclaimer, the term of this patent is extended or adjusted under 35 U.S.C. 154(b) by 0 days.

(21) Appl. No.: 09/068,292

(22) PCT Filed: Nov. 11, 1996

(86) PCT No.: PCT/SE96/01450

§ 371 (c)(1),
(2), (4) Date: Sep. 3, 1998

(87) PCT Pub. No.: WO97/18041

PCT Pub. Date: May 22, 1997

(30) Foreign Application Priority Data

Nov. 13, 1995 (SE) ..... 9504004

(51) Int. Cl.[7] ..... B21K 21/08

(52) U.S. Cl. ..... 29/890.142; 29/890.143; 29/451

(58) Field of Search ..... 29/890.142, 890.143, 29/890.07, 446, 450, 451; 264/328.1; 239/548, 596, 567, 552, 556, 558, 559, 602

(56) References Cited

U.S. PATENT DOCUMENTS

| | | | | | |
|---|---|---|---|---|---|
| 2,402,741 | A | * | 6/1946 | Draviner | 239/533.14 |
| 4,241,878 | A | * | 12/1980 | Underwood | 239/591 |
| 4,258,885 | A | * | 3/1981 | Legeza | 29/890.143 |
| 4,717,074 | A | * | 1/1988 | Karliner et al. | 29/890.143 |
| 5,172,862 | A | * | 12/1992 | Heimann et al. | 239/114 |
| 5,228,625 | A | * | 7/1993 | Grassberger | 239/558 |
| 5,405,089 | A | | 4/1995 | Heimann et al. | |
| 5,557,848 | A | * | 9/1996 | Povey | 29/890.143 |
| 5,594,987 | A | * | 1/1997 | Century | 29/890.143 |

FOREIGN PATENT DOCUMENTS

| | | |
|---|---|---|
| DE | 2235217 | 2/1973 |
| DE | 29 01 013 | 7/1980 |
| DE | 30 44310 | 6/1982 |
| DE | 43 08 599 | 5/1994 |
| DE | 43 12 859 | 5/1994 |

* cited by examiner

*Primary Examiner*—I Cuda Rosenbaum
*Assistant Examiner*—T. Nguyen
(74) *Attorney, Agent, or Firm*—Merchant & Gould P.C.

(57) ABSTRACT

The present invention relates to a method for manufacturing a jet diffusor for a shower head or the like, which jet diffusor is manufactured by two parts, a hole washer (13) of a hard plastic material and a nozzle washer (14) of an elastic rubber or plastic material. The nozzle washer (14) is manufactured, preferably by injection moulding, with a plain bottom disk (21) and with socket shaped nozzles (22) substantially perpendicularly arranged in relation to this, and raised from the bottom disk socket shaped nozzles (22). The hole washer (13) is manufactured, preferably by injection moulding, with at least one arched underside (15) and with the holes (16) arranged in diverging directions. The nozzle washer is brought to contact with the arched underside of the hole washer, so that the socket shaped nozzles are pressed into and partially through the holes, whereby the nozzles are subjected to a directional change according to the holes in the hole washer. The nozzles (22) provided with an expanded end section (23) are pressed so far into the holes (16) of the hole washer (13) that the end section is expanded behind a shoulder (19) provided in the hole.

12 Claims, 2 Drawing Sheets

METHOD FOR MANUFACTURING DIFFUSORS FOR SHOWER HEADS

TECHNICAL FIELD

The present invention relates to a method for manufacturing a jet diffusor for a shower head or the like, which jet diffusor is manufactured by two parts, a hole washer (13) of a hard plastic material and a nozzle washer (14) of an elastic rubber or plastic material.

BACKGROUND OF THE INVENTION

For long, it has been desired to clean the holes in a jet diffusor to shower armatures in an easy way. In the patent literature there are some different suggestions, of which only a few have been used in practice, however. Besides pollution, which can block the holes in the jet diffusor, lime deposits are the big problem. In DE 3107808 C2 a self cleaning head is suggested, where the water outlet openings are constituted by rubber elastic, pipe-like nozzle, which in an uninfluenced manner are closed and opened under the influence of water pressure. Since the nozzle are closed when the water is off, the thought was that the deposits would not be able to dry and get stuck in the nozzle. In a later development of a shower head according to DE 3943062 A1 it is suggested that the rubber elastic nozzle can be influenced by a device (a slide) which sweeps over the end sections of the nozzle, so that lime deposits can be broken loose and be rinsed.

Further, in the DE 4308599 A1 a shower head is suggested of above described type, i.e. comprising a hole washer of a hard plastic material and a nozzle washer of a rubber elastic material, where the nozzle washer with the help of an injection moulding tool is shaped directly toward the hole washer. Since the jet pattern of the shower is given, i.e. the single jets shall have diverging directions in relation to each other, complicated moulds are required, giving each nozzle an exact alignment.

DE 30 44 310 A1 describes a shower device with jet openings comprising elastic, pivotable piece of a hose, which by a slide or the like can be pivoted or turned for optional directional control of the jets.

DE 22 35 217 A discloses a shower device, which diffusor consists of a flexible washer, which by a means active at the center of the washer, can be brought to adopt a concave or a convex position, with the purpose to control the jet openings of the washer in different directions.

PURPOSE OF THE INVENTION AND MOST CHARACTERISING PARTS

The purpose of the invention is to provide a cheap product, which can be manufactured with simple injection moulding methods and tools keeping the established jet pattern of the shower. This object has been solved by manufacturing the nozzle washer, preferably by injection moulding, with a plain bottom disk and with socket shaped nozzles substantially perpendicularly arranged in relation to this, and raised from the bottom disk socket shaped nozzles, that the hole washer is manufactured, preferably by injection moulding, with at least one arched underside and with the holes arranged in diverging directions, that the nozzle washer is brought to contact with the arched underside of the hole washer, so that the socket shaped nozzles are pressed into and partially through the holes, whereby the nozzles are subjected to a directional change according to the holes in the hole washer.

DESCRIPTION OF THE DRAWINGS

The invention will be further described in an embodiment referring to the drawings.

DESCRIPTION OF THE PREFERRED EMBODIMENT

Figure 1:
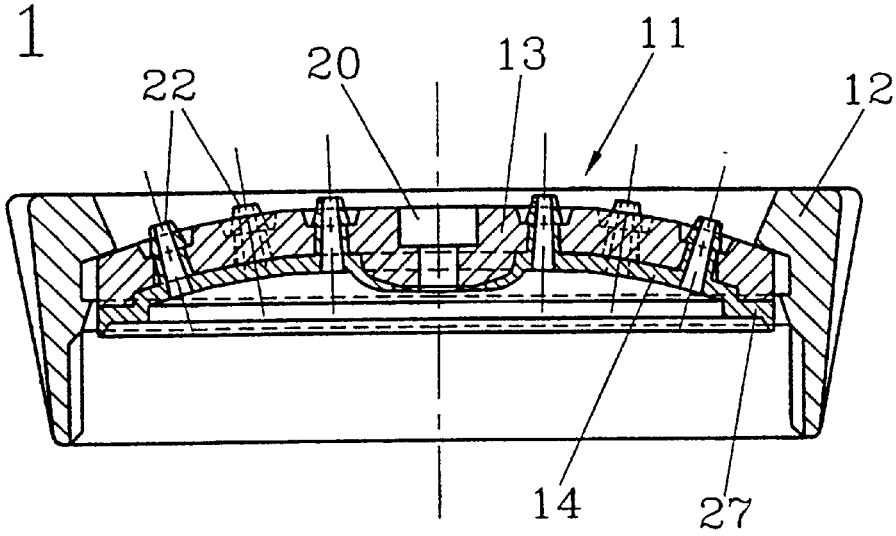
FIG. 1 shows a section through the jet diffusor according to the invention and its means of attachment.
Figure 2:
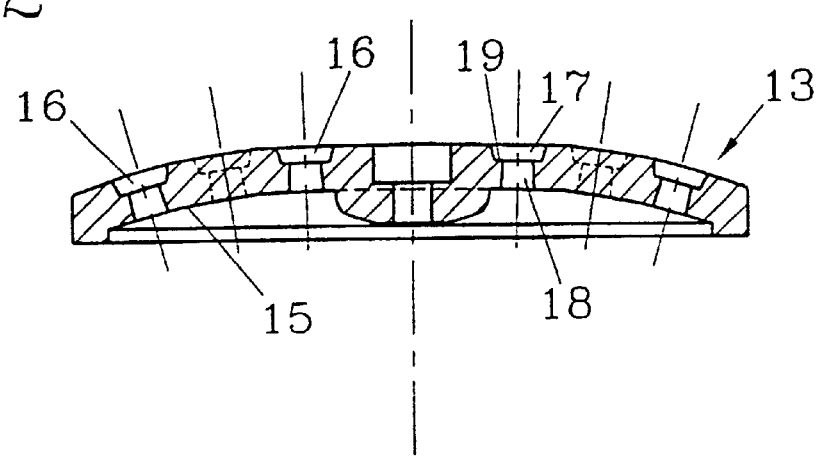
FIG. 2 shows a section through the hole washer of the jet diffusor.
Figure 3:
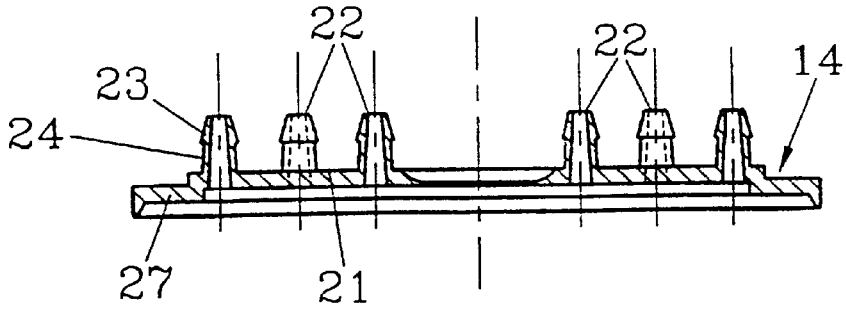
FIG. 3 shows a section through the nozzle washer of the jet diffusor.
Figure 4:
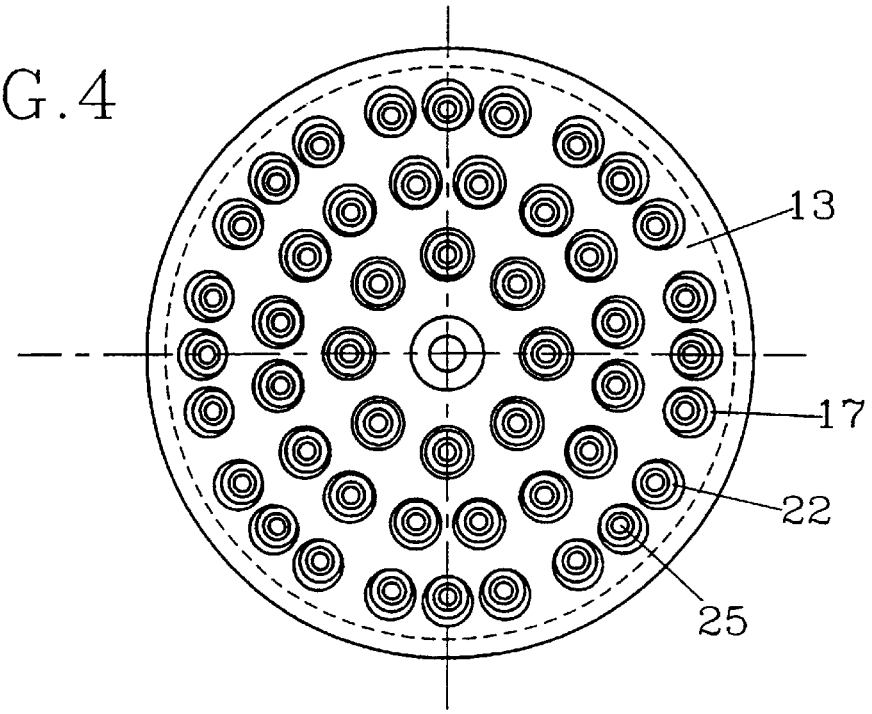
FIG. 4 shows a view from above of the jet diffusor according to FIG. 1.
Figure 5:
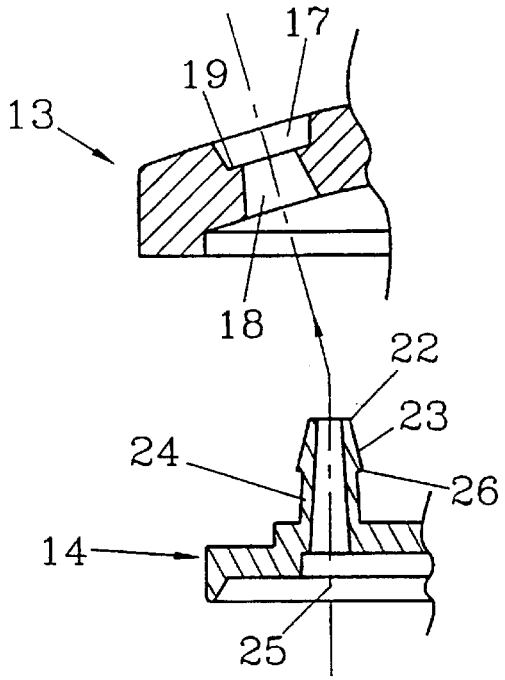
FIGS. 5 and 6 show an enlarged portion of the hole washer and the nozzle washer before and after the mounting.
Figure 6:
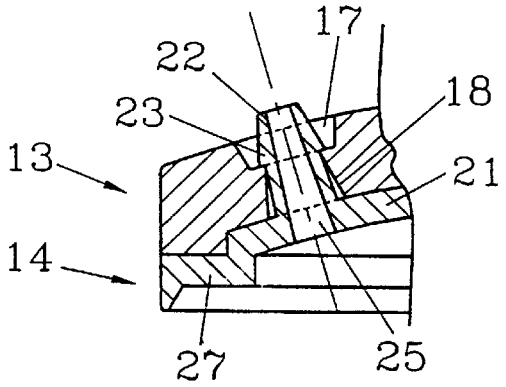

In FIG. 1 only a part of a shower head is visualised, namely the jet diffusor 11 and a means of attachment 12, in the form of a ring shaped nut, with which jet diffusor is fixed to the housing of the shower head, which is not shown, alternatively the means of attachment can also have the purpose of controlling the amount of the water percolation.

The jet diffusor 11 consists of two parts, a hole washer 13 and a nozzle washer 14, which under operation are connected to each other as presented in FIG. 1.

The hole washer 13 är manufactured of a hard plastic material, which even at temperatures at approximately 100 degrees centigrade is stable in form and which at least underside 15 is arched. In the hole washer 13, a number of holes 16 are arranged, which are arranged in diverging directions in relation to one another in accordance with the jet pattern, which the jet diffusor will have. The holes 16 are divided into an upper conical part 17 and a lower conical part 18, the first mentioned part having larger diameter than the lower part, so that that in the transition between these a shoulder 19 is arranged. Further, the hole washer can be provided with a central hole 20 for a screw, which fixes the hole washer to the shower head.

The nozzle washer 14 consists of a rubber elastic material and comprises a plain bottom disk 21 and from this raised socket shaped nozzles 22. These are designed with an expanded section 23 which via a flange 26 passes to a neck 24, which substantially is of the same length as the axial length of the hole part 18. The inner channel 25 of the nozzle is slightly conical in the direction of the nozzle openings. The expanded section 23 is dimensioned so that the flange 26 in the transition to the neck 24 can catch behind over the shoulder 19, whereby the flange 26 and the shoulder 19 engage to retain the nozzle washer 14 against the hole washer 13 when the hole washer and the nozzle washer are assembled.

The nozzle washer 14 is manufactured, suitably by injection moulding in a plain position with the nozzles 22 arranged substantially perpendicularly in relation to the bottom disk 21. This design and choice of conicity of the expanded section 23 and the inner channel 25 of the nozzles results in that the nozzle washer 14 can be manufactured by simple form tools, high manufacturing capacity and at low price. The same goes for the hole washer 13, where the double, opposite conicity of the hole parts 17 and 18 wherein the hole parts 17 and 18 are generally of the shape of cones intersecting proximate their tips, facilitates using simple form tools.

At the mounting of the nozzle washer 14 against the hole washer 13, which is accomplished by pressing the overside against the underside of the other part, the nozzles 22 will be forced to adjust to the position, which holes 16 of the hole washer take, so that the desired jet pattern of the jet diffusor is obtained.

Any further special fixing of the nozzle washer in relation to the hole washer is not required, since the snap action of the flange 26 of the expanded section 23 behind the shoulder 19 of the holes 16 is fully adequate. The nozzle washer 14 can also be designed with a peripheral sealing ring 27, which seals against the housing of the shower head.

What is claimed is:

1. A method for manufacturing a jet diffusor, the method comprising:

manufacturing an elastic nozzle washer comprising a bottom disk with raised nozzles thereon, the nozzles being substantially perpendicular to the bottom disk;

manufacturing a hole washer comprising an arched underside, the hole washer having holes therethrough, the holes having central axes that diverge from a central axis of the hole washer; and bringing the nozzle washer into contact with the arched underside of the hole washer, so that the nozzles are pressed into and partially through the holes, whereby the nozzles are forced to align with the central axes of the holes in the hole washer.

2. The method according to claim 1, wherein the holes comprise an upper part and a lower part, the upper part having a diameter greater than a diameter of the lower part.

3. The method according to claim 2, wherein the holes define a shoulder between the upper and lower parts.

4. The method according to claim 2, wherein the holes are generally of the shape of two cones intersecting proximate their tips.

5. The method according to claim 1, wherein the nozzle washer comprises rubber.

6. The method according to claim 1, wherein the nozzle washer comprises elastic plastic.

7. The method according to claim 1, wherein the nozzle washer is manufactured by injection molding.

8. The method according to claim 1, wherein the hole washer is manufactured by injection molding.

9. The method according to claim 1, wherein the nozzles are socket shaped.

10. The method according to claim 3, wherein the nozzles comprise an end section with a flange thereon and a neck section, wherein a diameter of the end section is greater than a diameter of the shoulder, and wherein a length of the neck section is generally the same as a length of the lower hole part, whereby when the nozzles are pressed into and partially through the holes, the flange and the shoulder engage to retain the nozzle washer against the hole washer.

11. A method of manufacturing a jet diffusor for a shower head comprising:

manufacturing a nozzle washer from an elastic material, the nozzle washer including a disk with nozzles projecting substantially perpendicularly therefrom, the nozzles each including an expanded end section;

manufacturing a hole washer from a hard plastic material, the hole washer including an arched underside and a plurality of holes extending through the hole washer, each said hole having a lower conical part and an upper conical part with a shoulder between the lower and upper conical parts, the diameter of the upper conical part being greater than the diameter of the lower conical part, and the holes having central axes that diverge from a central axis of the hole washer;

connecting the nozzle washer to the hole washer by pressing the nozzles of the nozzle washer into the holes of the hole washer until the expanded end sections snap behind the shoulders, whereby when connected the disk of the nozzle washer is in contact with the arched underside of the hole washer, the nozzles are parallel to the central axes of the holes, and the nozzles are movable sideways within the holes.

12. A method according to claim 11, wherein the lower conical part and the upper conical part have opposite conicity.

* * * * *